United States Patent [19]

Otaka

[11] 4,085,715

[45] Apr. 25, 1978

[54] IGNITION TIMING CONTROL SYSTEM

[75] Inventor: Syoichi Otaka, Saitama, Japan

[73] Assignee: Honda Giken Kogyo Kabushiki Kaisha, Tokyo, Japan

[21] Appl. No.: 712,347

[22] Filed: Aug. 6, 1976

[30] Foreign Application Priority Data

Aug. 11, 1975 Japan ..... 50-109915[U]

[51] Int. Cl.[2] ..... F02P 5/04

[52] U.S. Cl. ..... 123/117 A; 123/97 B

[58] Field of Search ..... 123/117 R, 117 A, 97 B

[56] References Cited

U.S. PATENT DOCUMENTS

| | | | |
|---|---|---|---|
| 3,457,905 | 7/1969 | Jukes | 123/117 A |
| 3,584,521 | 6/1971 | Tooker | 123/117 A |
| 3,638,627 | 2/1972 | Beard | 123/117 A |
| 3,665,904 | 8/1972 | Goodwillie | 123/117 A |
| 3,913,540 | 10/1975 | Hayashi | 123/117 A |
| 3,920,041 | 11/1975 | Gropp | 123/117 A |
| 4,016,844 | 4/1977 | Tanaka | 123/117 A |

*Primary Examiner*—Ronald B. Cox
*Attorney, Agent, or Firm*—Lyon & Lyon

[57] ABSTRACT

A system is disclosed for controlling the ignition timing for an internal combustion engine on a vehicle. The control effected is designed to increase mileage during low exhaust emission conditions and to better control exhaust emissions under conditions tending to increase such emissions. A double acting vacuum control mechanism is indirectly responsive to engine vacuum through a control valve arrangement which selects either increased advancement or increased retardation with increased engine vacuum as a function of the operating conditions of the engine. The operating conditions of the engine which determine the selection of the control valve position are vehicle speed and the degree of steady state operation referred to as cruising conditions.

1 Claim, 1 Drawing Figure

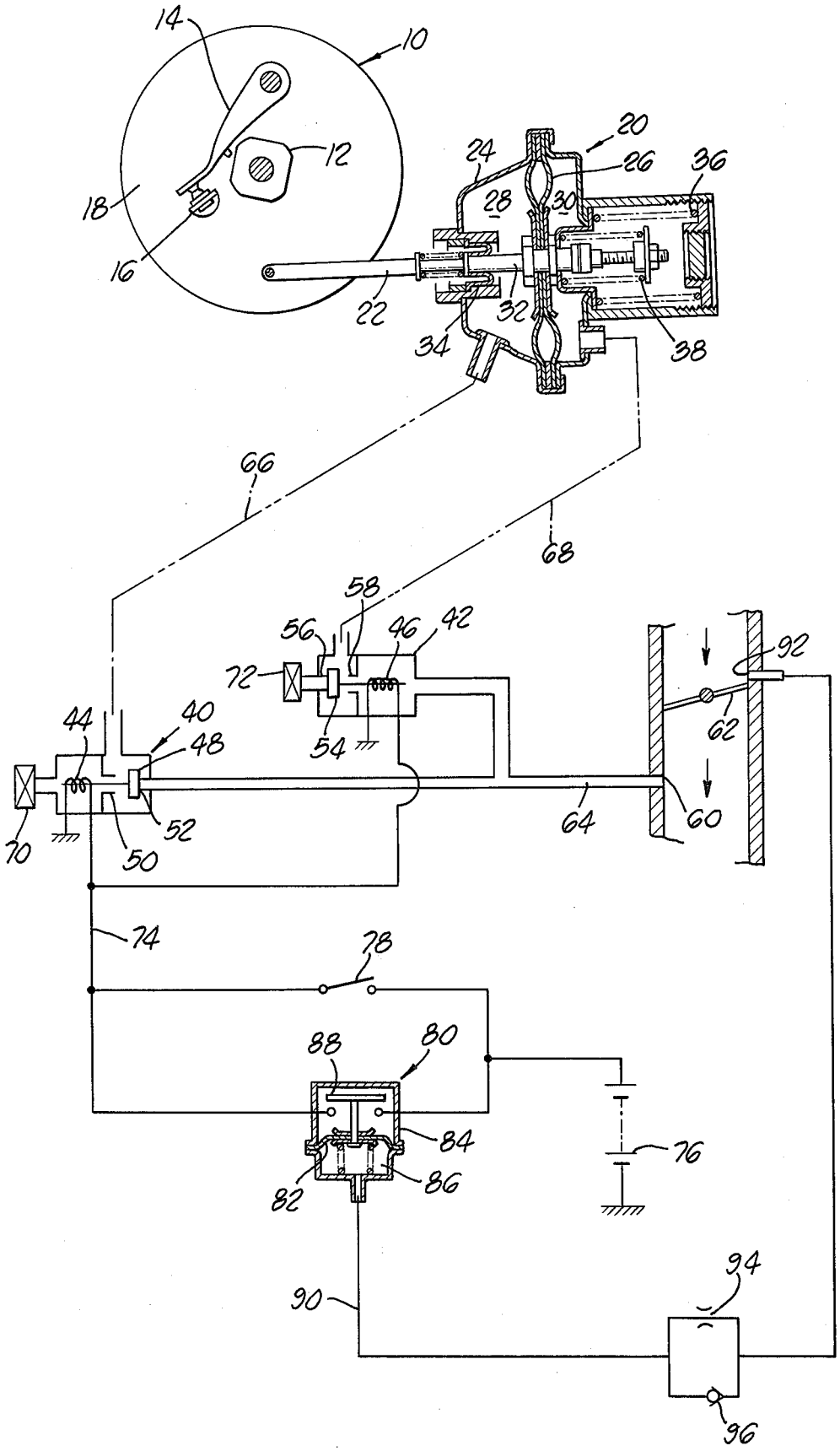
14
10
12
18
16
22
20
24
26
36
28
30
32
34
38
66
68
58
56
46
42
72
54
92
62
44
40
48
52
50
70
64
60
74
78
88
80
84
82
86
76
94
90
96

IGNITION TIMING CONTROL SYSTEM

The present invention is directed to an ignition timing control system. More specifically, the ignition timing control system of the present invention is responsive to engine vacuum, engine speed, and the degree of steady state operating conditions.

Vacuum actuated timing control of ignition systems for internal combustion engines has long been employed as a means for improving engine performance under variable engine loads. However, with the advent of strict emission controls, such timing control mechanisms have been greatly altered because of the tendency of more conventional timing control mechanisms to increase exhaust pollutants.

In general, the design of such systems to effect minimum exhaust emissions has resulted in increased gasoline consumption. It has been earlier proposed that ignition timing should be retarded at low vehicle speeds as a function of engine vacuum for reducing the amount of exhaust pollutants. At high vehicle speeds, the timing control mechanism was to provide ignition timing advance as a function of engine vacuum to decrease fuel consumption during conditions of low exhaust pollution. To accomplish this earlier system, a control valve responsive to vehicle speed was employed to alternatively supply engine vacuum to one side or the other of a diaphragm of an actuator assembly which in turn controlled the timing adjustment mechanism of a distributor. However, it remained that retarded timing control during low speed running was not necessarily desirable under all conditions. Thus, an engine employing such a system continued to waste fuel during a significant portion of running time when exhaust emissions were well under control.

The present invention is directed to a system for controlling the ignition timing for internal combustion engines mounted on vehicles such that fuel saving is achieved at both low and high vehicle speeds. The control effected by the present invention promotes decreased exhaust pollution under operating conditions which generally create high levels of exhaust pollutants and decreased fuel consumption under operating conditions which generally experience low levels of pollutants in the exhaust. To decrease gasoline consumption even at low speeds, an ignition timing control mechanism is employed which allows vacuum advance during low speed steady state driving conditions, cruising conditions, as well as during high speed operations. When the vehicle is operating under conditions of both low speed and unsteady state loads, the ignition timing control causes the timing to be retarded as a function of engine vacuum. Thus, both emission control and fuel economy are achieved wherever possible.

To accomplish the foregoing operation, a double acting vacuum actuator is employed to control a timing adjustment mechanism associated with the vehicle distributor. The double acting vacuum actuator is indirectly associated with the engine vacuum developed at the intake through a control valve which is employed to selectively distribute the vacuum to one side or the other of a diaphragm in the double acting vacuum actuator. The control valve mechanism is biased to a first position causing the timing adjustment mechanism to retard the timing upon an increase in engine vacuum. The bias load is overcome by an actuating solenoid mechanism when steady state engine conditions or high vehicle velocity are experienced.

Accordingly, it is an object of the present invention to provide an improved ignition timing control system.

It is another object of the present invention to provide an ignition timing control system employing ignition timing advance during steady state driving conditions at all driving speeds and ignition timing retardation during low speed unsteady state driving conditions.

Other and further objects and advantages will appear hereinafter.

The drawing schematically illustrates the present invention.

Turning in detail to the schematic drawing, a distributor 10 of conventional design is illustrated as including a contact breaker cam 12, a contact lever 14, a contact point 16 and a base 18 to which the contact lever 14 and the contact point 16 are mounted. The base 18 is pivotally mounted to the distributor 10 such that rotation thereof will result in the advancement or retardation of the ignition timing.

An actuator assembly 20 is shown to be coupled with the base 18 by means of a linkage arm 22. The linkage arm 22 is pinned to the base 18 and is caused by the actuator assembly 20 to move substantially along its length. In this way, the actuator assembly 20 is able to pivot the base 18 to control the advancement and retardation of the ignition timing.

The actuator assembly 20 is designed to provide two drive mechanisms by which different vacuum input will cause actuation in two directions. To accomplish this, a main housing 24 surrounds a diaphragm 26 to create first and second vacuum chambers 28 and 30 which operate as the two driving mechanisms in the present embodiment. Movably positioned through the actuator assembly 20 is an actuator rod 32 conventionally associated with the diaphragm 26. The actuator rod 32 is in turn associated with the linkage arm 22 such that pressure differentials on the diaphragm 26 will result in advancement or retardation of the ignition timing. A seal 34 prevents leakage of air by the actuator rod 32. Two springs 36 and 38 allow adjustable resistence to motion of the actuator rod 32 in either direction.

Control valve means are provided in the present invention for alternatively directing engine vacuum to actuate the two drive mechanisms of the actuator assembly 20. In the present embodiment, two separate valve assemblies 40 and 42 are provided which cooperate with each other by means of a single input signal directed to each valve. Each valve assembly 40 and 42 has two positions and is driven from one to the other of these positions by means of actuating solenoids 44 and 46 which form a part of a valve actuator means that includes energizing circuitry and switches as will be described below. Valve assembly 40 includes a valve 48 operatively associated with the solonoid 44 to assume one of two possible positions against the valve seats 50 and 52. The actuating solenoid 44 is designed to include a bias means such that the valve 48 is biased against the valve seat 52 when the solenoid is not energized. When the actuating solenoid 44 is energized, the valve 48 assumes the second position against the valve seat 50.

The valve assembly 42 is of a similar type and includes a valve 54 which may be positioned against either of two valve seats 56 and 58. The actuating solenoid 46 is biased so that the valve 54 will remain against the valve seat 56 when the solenoid 46 is not energized.

When the solenoid 46 is energized, the valve 54 is drawn against the valve seat 58.

Engine vacuum is tapped from the intake at an outlet 60 which extends through the wall of the engine intake passageway below the throttle valve 62. A vacuum passageway 64 extends to both valve assemblies 40 and 42. The vacuum passageway 64 is controlled by means of the valves 48 and 54 at the valve seats 52 and 58. Controlled communication of the vacuum from the vacuum passageway 64 to either vacuum chamber 28 and 30 is through control passageways 66 and 68.

With the actuating solenoids 44 and 46 in a de-energized condition, the vacuum passageway 64 is prevented from communicating with the control passageway 66 and hence the vacuum chamber 28. At the same time, the vacuum passageway 64 is in direct communication with the control passageway 68 and in turn the vacuum chamber 30.

Under the above conditions, the actuator assembly 20 causes the timing adjustment mechanism of the distributor 10 to assume a retarded timing. The retarded timing is naturally dependent on the amount of vacuum experienced in the intake passageway below the throttle valve 62. As vacuum is provided to the vacuum chamber 30, air is allowed into the vacuum chamber 28 through intake 70, valve seat 50 and control passageway 66.

With the actuating solenoids 44 and 46 energized, the control passageway 68 is shut off from the vacuum passageway 64 while an intake port 72 is opened. Thus, atmospheric pressure is allowed into the vacuum chamber 30. At the same time, the vacuum passageway 64 is opened to communicate with the control passageway 66 such that vacuum is experienced in the vacuum chamber 28. This action causes the actuator assembly 20 to respond to vacuum experienced in the intake passageway of the engine to advance rather than retard the ignition timing.

The actuating solenoids 44 and 46 are energized by a common signal provided through conductor 74. The conductor 74 is associated with an alternator, generator, battery or other direct current source 76 through two switches 78 and 80 which are positioned in electrically parallel relationship such that either may energize the actuating solenoids 44 and 46.

Switch 78 is a velocity switch which is actuated by a conventional velocity detector mechanism when the speed of the vehicle reaches a certain level, for instance 80 kilometers per hour.

Switch 80 is associated with a cruise detector such that switch 80 will be closed when the vehicle experiences a sustained steady state driving condition for an appropriate period of time. The switch 80 includes a diaphragm 82 set within a housing 84 to define a vacuum chamber 86. Directly coupled to the diaphragm 82 is a contact bar 88 which may be drawn by vacuum within the vacuum chamber 86 to close the circuit between the power source 76 and the actuating solenoids 44 and 46. In order that a cruising condition is detected by the switch 80, a vacuum line 90 extends from an opening 92 slightly above the throttle valve 62 in the intake passageway of the engine. This vacuum line 90 is able to slowly extract air from the vacuum chamber 86 in the cruise detector switch 80 through a small orifice 94. Slowly, vacuum will build up in the vacuum chamber 86 to close the switch 80. However, if steady state conditions are not continued, at one point in time the vacuum in the intake passageway at the opening 92 will be reduced such that a check valve 96 will allow air to rapidly flow back into the vacuum chamber 86. If steady state or cruise conditions are not reached, the rapid release of the vacuum through the check valve 96 will prevent the slow draining of air through the orifice 94 from ever closing the switch. However, regardless of the actual speed of the vehicle, a steady state cruise condition can result in a change from the spark retarded condition to a spark advance condition for fuel economy.

Thus, an ignition timing control system is here disclosed which provides for a retarded spark proportionally related to an increase in engine vacuum during low speed unsteady state conditions. At the same time, the ignition timing control system effects ignition timing advance proportional to an increase in engine vacuum when the vehicle is running at high speeds or when the vehicle is driven at a steady state, cruise condition regardless of the vehicle speed. In this way, conditions are fostered for low exhaust emissions during engine operating conditions conducive to relatively high emissions while good gasoline mileage is promoted during operating conditions normally conducive to low exhaust emission levels. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An ignition timing control apparatus for an internal combustion engine on a vehicle, the engine having an intake passageway with a throttle valve, comprising: a distributor having a timing adjustment mechanism, an actuator assembly for positioning said timing adjustment mechanism, said actuator assembly including a housing, a diaphragm, an actuator fixed to move with said diaphragm, an outlet in the intake passageway below the throttle valve, a first drive mechanism for driving said actuator in a first direction responsive to increased engine vacuum at said outlet, said first drive mechanism being defined by a first portion of said housing in cooperation with said diaphragm, a second drive mechanism for driving said actuator in a second direction responsive to increased engine vacuum at said outlet, said second drive mechanism being defined by a second portion of said housing in cooperation with said diaphragm, linkage for coupling said actuator to said timing adjustment mechanism such that movement of said actuator in said first direction will advance said timing adjustment mechanism, and movement of said actuator in said second direction will retard said timing adjustment mechanism, control valve means including a first valve assembly, a second valve assembly, a vacuum passageway extending from said outlet, said first valve assembly including a first valve, a first actuating solenoid, first biasing means, said first valve connecting said first drive mechanism to said vacuum passageway when said first actuating solenoid is energized and to atmosphere by said first biasing means when said first actuating solenoid is de-energized, said second valve assembly including a second valve, a second actuating solenoid, second biasing means, said second valve connecting said second drive mechanism to atmosphere when said second actuating solenoid is energized, and to said vacuum passageway by said second biasing means when said second actuating solenoid is de-energized, valve actuator means including a cruise switch for energizing said actuating solenoids when the internal combustion engine is operating under steady state driving conditions, said cruise switch including a vacuum actuated switch, an opening slightly above said throttle valve in said intake passageway, a vacuum line extending from said opening, two-way valve means positioned in said vacuum line, said two-way valve means including parallel passageways, a restrictive orifice in one of said parallel passageways, a check valve in the other of said parallel passageways, said two-way valve means allowing slow vacuum build-up in said vacuum actuated switch and allowing fast vacuum release in said valve actuated switch, and a vehicle velocity switch for energizing said actuating solenoids when the vehicle attains a preselected velocity, said control valve means being actuated by either of said vehicle velocity switch and said cruise switch.

* * * * *